US007131490B1

(12) United States Patent
Roskewich

(10) Patent No.: US 7,131,490 B1
(45) Date of Patent: Nov. 7, 2006

(54) FAN COIL CONTROLLER

(75) Inventor: Kenneth E. Roskewich, Edmonton (CA)

(73) Assignee: T.K.M. Contracting and Metal Industry Ltd. (CA)

( * ) Notice: Subject to any disclaimer, the term of this patent is extended or adjusted under 35 U.S.C. 154(b) by 0 days.

(21) Appl. No.: 11/107,157

(22) Filed: Apr. 15, 2005

(51) Int. Cl.
*F25B 29/00* (2006.01)

(52) U.S. Cl. ..... 165/303; 165/50; 165/95; 165/221; 165/267; 236/46 R; 236/1 C; 236/37; 236/38

(58) Field of Classification Search ..... 165/303, 165/50, 95, 278, 218, 219, 220, 221, 267; 236/46 R, 1 C, 37, 38; 62/157
See application file for complete search history.

(56) References Cited

U.S. PATENT DOCUMENTS

| | | | | | |
|---|---|---|---|---|---|
| 3,024,007 | A | * | 3/1962 | Gordon | 165/216 |
| 3,138,326 | A | * | 6/1964 | Berger | 236/1 C |
| 3,158,081 | A | * | 11/1964 | Frost | 454/337 |
| 3,166,120 | A | * | 1/1965 | Butterfield et al. | 165/218 |
| 3,256,929 | A | * | 6/1966 | Carlson | 165/221 |
| 3,257,778 | A | * | 6/1966 | Flagg | 96/46 |
| 3,265,371 | A | * | 8/1966 | McGrath | 261/27 |
| 3,351,128 | A | * | 11/1967 | Barnd | 165/219 |
| 3,425,485 | A | * | 2/1969 | Newton | 165/218 |
| 4,013,219 | A | * | 3/1977 | Jacobson | 236/46 R |
| 4,775,100 | A | * | 10/1988 | Gouldey et al. | 236/46 R |
| 5,261,483 | A | | 11/1993 | Imaoka | |
| 5,460,221 | A | * | 10/1995 | Stalsberg et al. | 165/259 |
| 5,592,989 | A | | 1/1997 | Lynn et al. | |
| 6,126,079 | A | * | 10/2000 | Shoemaker | 236/35 |

FOREIGN PATENT DOCUMENTS

| | | | |
|---|---|---|---|
| CN | 1587844 | A * | 3/2005 |
| JP | 57150750 | A * | 9/1982 |
| JP | 01155924 | A * | 6/1989 |
| JP | 04084034 | A * | 3/1992 |

OTHER PUBLICATIONS

Schwartz, John, "Tips on Automatic Control of Fan-Coil Units" Apr. 1960, Air Conditioning, Heating and Ventilating, pp. 69-71.*
"IMACS Control Electronics" brochure. version dated Sep. 8, 2003, 6 pages.
"Technological Studies: Systems and Control Students' Notes (H) Outcome 3", first published 1998, Higher Still Developmental Unit, 84 pages.

(Continued)

*Primary Examiner*—John K. Ford
(74) *Attorney, Agent, or Firm*—Frank J. Dykas; Dykas, Shaver & Nipper, LLP

(57) ABSTRACT

A fan coil controller for a hot and cold water system of a building that turns off the fan while the hot water and cold water coils are flushed. A fan coil control circuit is configured to periodically and temporarily operate a hot water flow control circuit and a cold water flow control circuit to cause a flushing of the hot and cold water system and simultaneously provide a signal to a fan control circuit to prevent the thermostat enabling the fan during flushing of the hot and cold water system.

2 Claims, 2 Drawing Sheets

OTHER PUBLICATIONS

"Honeywell: T6380 Series Electronic Fan Coil Thermostats", brochure, Honeywell Ltd., Aug. 1998, Canada, 6 pages.

"Excel 10: W7752D,E,F,G Fan Coil Unit Controllers", brochure, Honeywell Inc., Jun. 1998, U.S.A., 4 pages.

"AE Series: Fan Coil Units", web page, http://www.aldag.com.tr/en/ae.htm, Aldag, printed off the Internet on Jul. 29, 2004, 2 pages.

"Outback Marine CWS Control Panel Products", web page, http://www.outbackmarine.com.au/, Outback Marine Australia Pty Ltd, printed off the Internet on Jul. 29, 2004, 4 pages.

* cited by examiner

FAN COIL CONTROLLER

BACKGROUND OF THE INVENTION

Background Information

Many buildings have heating and cooling systems that use air blown by a fan past water filled coils for heating and cooling. Hot water coils are used for heating, while cold water coils are used for cooling. Regulations may require that domestic water be used for the hot and cold water. During summer, the hot water coils may rarely be used, and in winter the cold water coils may rarely be used. In these cases, the water in the coils may become stale and building code regulations may require regular flushing of the coils. If the fan is on during flushing, the heating and cooling process can become disrupted.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

There is therefore provided, in accordance with an aspect of the invention, a fan coil controller for a hot and cold water system of a building that prevents turning on of the fan while the hot water and cold water coils are flushed. The fan coil controller may comprise a hot water flow control circuit, a cold water flow control circuit, a thermostat, and a fan coil control circuit configured to periodically and temporarily operate the hot water flow control circuit and the cold water flow control circuit. Operation of the control circuits causes a flushing of the hot and cold water system and simultaneously disconnects the hot and cold water control circuits from the thermostat.

These and other aspects of the invention are set out in the claims, which are incorporated here by reference.

The purpose of the foregoing Abstract is to enable the United States Patent and Trademark Office and the public generally, and especially the scientists, engineers, and practitioners in the art who are not familiar with patent or legal terms or phraseology, to determine quickly from a cursory inspection, the nature and essence of the technical disclosure of the application. The Abstract is neither intended to define the invention of the application, which is measured by the claims, nor is it intended to be limiting as to the scope of the invention in any way.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive in nature.

BRIEF DESCRIPTION OF THE DRAWINGS

Preferred embodiments of the invention will now be described with reference to the figures, in which like reference characters denote like elements, by way of example, and in which.

DESCRIPTION OF THE PREFERRED EMBODIMENTS

Figure 1:
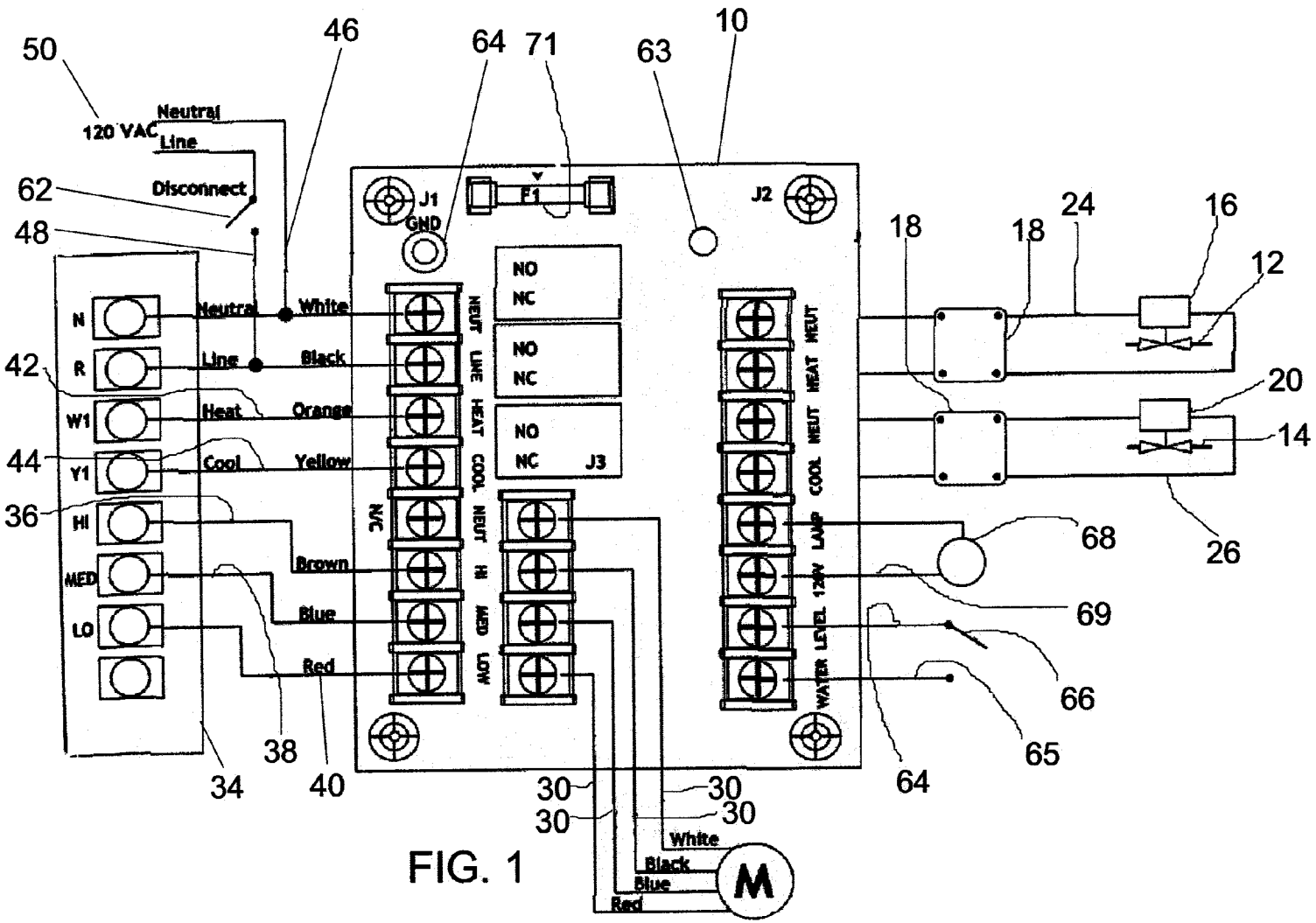
FIG. 1 is a fan coil wiring diagram for an embodiment of the invention.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

In the claims, the word "comprising" is used in its inclusive sense and does not exclude other elements being present. The indefinite article "a" before a claim feature does not exclude more than one of the feature being present.

In FIG. 1, a fan coil controller 10 controls flow of water in a hot water circuit 12 and cold water circuit 14 of a building (not shown). Flow in the hot water circuit 12 is controlled by a flow control device 16, which may be a solenoid valve as shown or a pump such as a conventional 120 V Fractional HP pump or other suitable flow control device installed in the building, usually by others. If a 120 VAC 0.2A solenoid valve is used, then no transformer 18 is required, but if a 24 VAC solenoid valve 24 is used, then a transformer 18 as shown in FIG. 1 should be used. Flow in the cold water circuit 14 is controlled by a flow control device 20, which may be a solenoid valve or a condenser or other suitable flow control device supplied by the building. If a 120 VAC 0.2A solenoid valve is used, then no transformer 18 is required, but if a 24 VAC solenoid valve is used, then a transformer 18 as shown in FIG. 1 should be used. The fan coil controller 10 provides control signals to the flow control devices 16 and 20 through a hot water flow control circuit 24 and a cold water flow control circuit 26 respectively. Transformers 18 or other electrical conversion or isolation devices may be used in the hot water flow control circuit 24 and cold water flow control circuit 26 if electrical isolation or conversion is desirable or required for the flow control devices 16, 20.

The controller 10 is also connected through a fan control circuit 30 to a fan 32, which may be a 120 VAC ½ HP multispeed fan. The fan 32 drives air past coils of the hot water circuit 12 and cold water circuit 14 depending on heating requirements. Choice of heating or cooling is made by conventional thermostat 34, which provides high, medium or low control signals through lines 36, 38 and 40 respectively to the fan control circuit 30. The thermostat 34 also provides a heating signal through line 42 to the hot water flow control circuit 24 and a cooling signal through line 44 to the cold water flow control circuit 26 in accordance with the conventional operating principles of the thermostat 34. The controller 10 and thermostat 34 are each supplied power through lines 46 and 48 from power supply 50. Switch 52 is provided on the live line 48 and is controlled by the controller 10.

Figure 2:
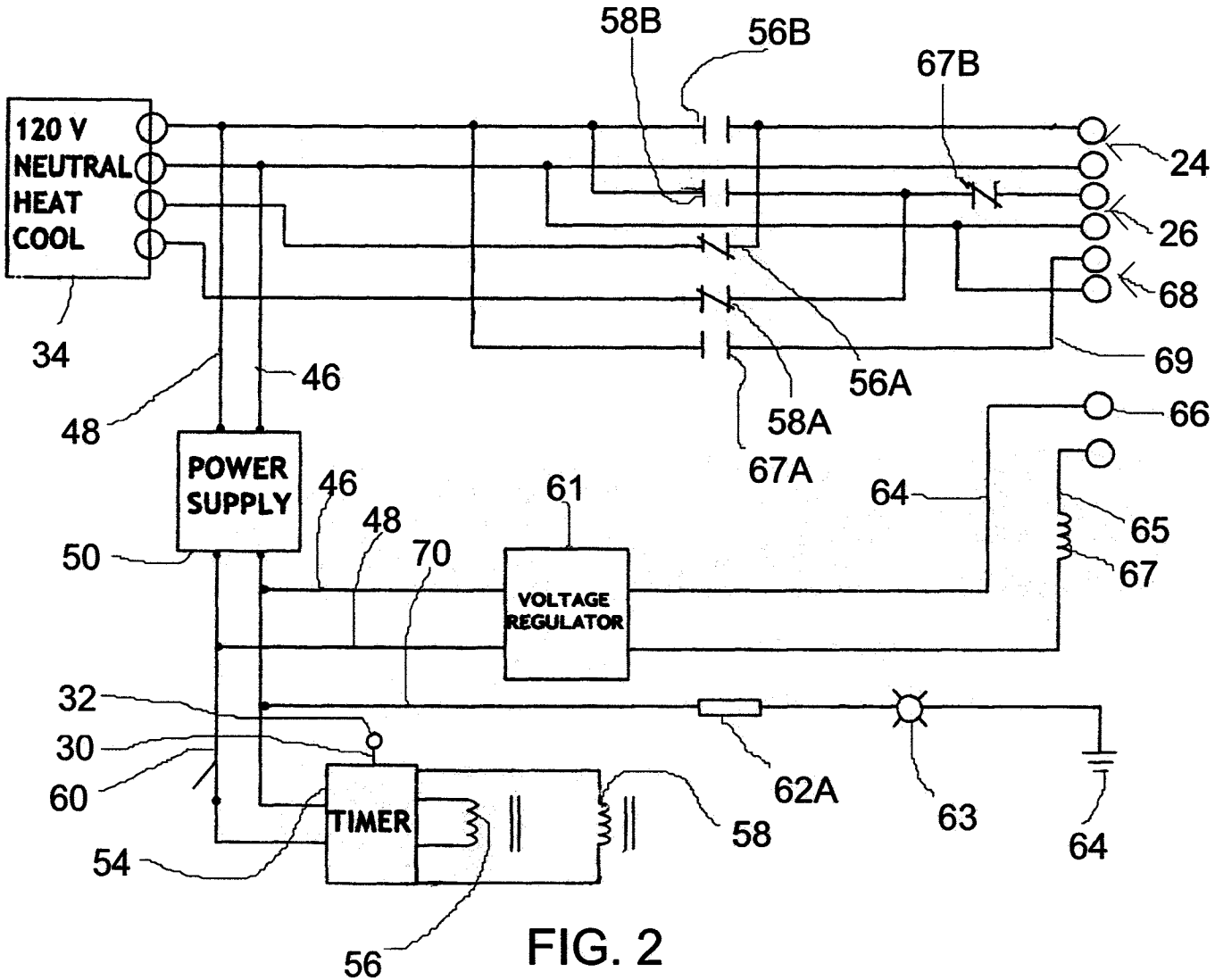
FIG. 2 is a circuit schematic for a control circuit for the embodiment of FIG. 1.

In FIG. 2, the fan coil controller 10 is configured to periodically and temporarily operate the hot water control circuit 24 and the cold water control circuit 26. Operation of the hot water control circuit 24 and cold water control circuit 26 opens the flow control devices 16 and 20 respectively to cause a flushing of the hot and cold water system formed of hot water circuit 12 and cold water circuit 14. While the hot water circuit 12 and cold water circuit 14 may be flushed independently, and the fan 32 turned off while each is flushed, it is preferable for both the circuit 12 and 14 to be flushed at the same time. Flushing should take place as required by building codes, for example once every 24 hours.

The fan coil controller 10 is powered by power supply 50 and incorporates a timer 54, a relay 56 on the hot water flow control circuit 24 and a second relay 58 on the cold water flow control circuit 26. The relay 56 is controlled by the timer 54 to control electrical power supplied to the hot water flow control circuit 24. The relay 58 is controlled by the timer 54 to control electrical power supplied to the cold water flow control circuit 26. When the relay 56 is energized by the timer 54 to cause flushing of the hot water circuit 12, normally closed contacts 56A on the heat control line 42 from the thermostat 34 to hot water flow control circuit 24 open and normally open contacts 56B on the hot water flow control circuit 24 close. When the relay 58 is energized by the timer 54 to cause flushing of the cold water circuit 12, normally closed contacts 58A on the cold control line 44 from the thermostat 34 to cold water flow control circuit 24 open and normally open contacts 58B on the cold water flow control circuit 26 close. Drain resistors (not shown) built into the controller board are used to drain any residual emf in the solenoids. By virtue of the relays 56A and 58A, operation of the control circuits 24 and 26 will not enable the fan 32 during periodic flushing will not cause a signal to be sent to start the fan 32.

The voltage regulator is supplied power through lines 46 and 48 from power supply 50. Low voltage power from voltage regulator 61 is supplied to condensate switch 66 through lines 64 and 65. If condensate line from fan coil 32 becomes plugged and condensate water threatens fan coil 32 drain pan overflow, condensate water level switch 66 supplies power to alarm relay coil 67. When alarm relay coil 67 is energized, relay contact 67A closes and supplies power to alarm light 68 on circuit 69. When alarm relay 67 is energized, relay contact 67B closes and breaks power supply to circuit 26, thus preventing cool solenoid 20 from opening. If power supply 50 is wired incorrectly, circuit 70 provides power to resistor 62A and polarity light 63 to earth ground 64. When polarity light 63 is illuminated, power connections must be corrected.

The fan coil control system described may be used with any fan coil system that uses domestic hot and cold water for heating and cooling. The timer preferably flushes stale water from the heating and cooling systems each 24 hours. A one to five minute flush is adequate for most systems. While in flush mode, the board prevents 120 volt feedback to the thermostat. Preferably, a 120 V control system is used for temperature and fan speed selection. This allows for any type of line voltage thermostat to be used. Surge protection may be provided with suitable fuses. Switch 62 allows for a line disconnect. A conventional fuse 71 should be incorporated into the circuit at a convenient location according to electrical code requirements.

Immaterial modifications may be made to the embodiments of the invention described here without departing from the invention.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

I claim:

1. A fan coil controller for a hot and cold water system of a building, the fan coil controller comprising:

a hot water flow control circuit;

a cold water flow control circuit;

a thermostat, the thermostat being connected to a power supply;

a fan coil control circuit incorporating a timer, a first relay on the hot water flow control circuit and a second relay on the cold water flow control circuit;

the first relay being controlled by the timer to control electrical power supplied to the hot water flow control circuit and to control a connection between the hot water control circuit and the thermostat;

the second relay being controlled by the timer to control electrical power supplied to the cold water flow control circuit and to control a connection between the cold water control circuit and the thermostat; and the fan coil control circuit being configured to periodically and temporarily operate the hot water flow control circuit and the cold water flow control circuit to cause a flushing of the hot and cold water system while simultaneously disconnecting the hot water control circuit and the cold water control circuit from the thermostat during flushing.

2. The fan coil controller of claim 1 in which:

the hot water control circuit includes a hot water control device connected within the hot water supply of a building; and the cold water control circuit includes a cold water control device connected within the cold water supply of a building.

* * * * *